US011767645B2

(12) United States Patent
Berning et al.

(10) Patent No.: US 11,767,645 B2
(45) Date of Patent: Sep. 26, 2023

(54) SELF-PROPELLED CONSTRUCTION MACHINE AND METHOD FOR OPERATING A SELF-PROPELLED CONSTRUCTION MACHINE

(71) Applicant: Wirtgen GmbH, Windhagen (DE)

(72) Inventors: Christian Berning, Zülpich (DE); Andreas Salz, Neustadt (DE); Martin Quadt, Eitorf (DE)

(73) Assignee: Wirtgen GmbH

( * ) Notice: Subject to any disclaimer, the term of this patent is extended or adjusted under 35 U.S.C. 154(b) by 0 days.

(21) Appl. No.: 17/701,937

(22) Filed: Mar. 23, 2022

(65) Prior Publication Data

US 2022/0316156 A1 Oct. 6, 2022

(30) Foreign Application Priority Data

Apr. 1, 2021 (DE) ..... 10 2021 108 367.2

(51) Int. Cl.

| | |
|---|---|
| ***E01C 23/088*** | (2006.01) |
| ***E01C 23/12*** | (2006.01) |
| *E01C 21/00* | (2006.01) |
| *E01C 23/06* | (2006.01) |

(52) U.S. Cl.

CPC ..... *E01C 23/088* (2013.01); *E01C 23/127* (2013.01); *E01C 21/00* (2013.01); *E01C 23/065* (2013.01)

(58) Field of Classification Search

CPC ..... E01C 19/12; E01C 19/187; E01C 19/42; E01C 21/00; E01C 23/065; E01C 23/088; E01C 23/09; E01C 23/12; E01C 23/127; E02F 3/8152; E02F 3/8155; E02F 3/8157; E02F 3/844; E02F 3/845

USPC ..... 404/75

See application file for complete search history.

(56) References Cited

U.S. PATENT DOCUMENTS

| | | | |
|---|---|---|---|
| 4,041,623 | A | 8/1977 | Miller et al. |
| 5,114,267 | A | 5/1992 | Smith et al. |
| 7,530,641 | B2 | 5/2009 | Berning et al. |
| 8,246,270 | B2 | 8/2012 | Berning et al. |
| 8,485,755 | B2 | 7/2013 | Menzenbach et al. |

(Continued)

FOREIGN PATENT DOCUMENTS

| | | | |
|---|---|---|---|
| DE | 102006062129 | A1 | 7/2008 |
| DE | 202008016935 | U1 | 7/2010 |

(Continued)

*Primary Examiner* — Janine M Kreck
*Assistant Examiner* — Michael A Goodwin
(74) *Attorney, Agent, or Firm* — Lucian Wayne Beavers; Patterson Intellectual Property Law, PC

(57) ABSTRACT

A self-propelled construction machine, having a milling drum housing having a sealing device which has a sealing element arranged in the working direction of the construction machine behind the milling drum, an adjustment device for adjusting the height position of the sealing element, and a controller for controlling the adjustment device of the sealing element. The sealing device has a scraper element, which is pivotably arranged on the sealing element such that the scraper element rests on the milled material and is pivoted in relation to the milling drum on the basis of the height of the milled material. The height position of the sealing element is adjusted on the basis of the pivot position of the scraper element.

18 Claims, 8 Drawing Sheets

(56) References Cited

U.S. PATENT DOCUMENTS

| | | | | |
|---|---|---|---|---|
| 8,764,341 | B2 | 7/2014 | Menzenbach et al. | |
| 8,807,867 | B2 | 8/2014 | Berning et al. | |
| 9,322,139 | B2 | 4/2016 | Berning et al. | |
| 9,422,677 | B2 | 8/2016 | Franzmann et al. | |
| 9,644,330 | B2 | 5/2017 | Berning et al. | |
| 2007/0286678 | A1 | 12/2007 | Berning et al. | |
| 2012/0128419 | A1* | 5/2012 | Menzenbach | E01C 23/065 404/90 |
| 2012/0286558 | A1 | 11/2012 | Berning et al. | |
| 2013/0249271 | A1 | 9/2013 | Killion | |
| 2013/0322963 | A1* | 12/2013 | Forster | E02F 3/241 404/91 |
| 2013/0341996 | A1* | 12/2013 | Franzmann | E01C 23/088 299/1.5 |
| 2015/0054331 | A1* | 2/2015 | Berning | E01C 23/088 299/1.5 |
| 2016/0186391 | A1* | 6/2016 | Wachsmann | E01C 23/088 299/1.5 |
| 2022/0162815 | A1* | 5/2022 | Muir | E01C 23/01 |

FOREIGN PATENT DOCUMENTS

| | | | |
|---|---|---|---|
| DE | 102012012397 | A1 | 4/2014 |
| DE | 102013013967 | A1 | 3/2015 |
| EP | 1860241 | A2 | 11/2007 |
| EP | 1936034 | A2 | 6/2008 |
| EP | 2455544 | A2 | 5/2012 |

* cited by examiner

SELF-PROPELLED CONSTRUCTION MACHINE AND METHOD FOR OPERATING A SELF-PROPELLED CONSTRUCTION MACHINE

BACKGROUND OF THE INVENTION

Field of the Invention

The invention relates to a self-propelled construction machine, in particular a road milling machine, recycler or stabiliser, having a machine frame and a milling drum which is arranged in a milling drum housing having a sealing device which has at least one sealing element arranged in the working direction of the construction machine behind the milling drum for closing the milling drum housing, an adjustment device for adjusting the height position of the sealing element in relation to the milling drum, and a controller for controlling the adjustment device of the sealing element.

Description of the Prior Art

With the known road milling machines, the road surface can be milled off true to contour and evenly. A distinction must be made between road milling machines and so-called stabilisers or recyclers, which, by adding binding agents, produce a load-bearing substructure from a non-load-bearing substrate, for example, loose soil (stabiliser) or a damaged carriageway (recycler), which is suitable for the subsequent construction of a carriageway. Road milling machines and stabilisers or recyclers have a work drum, hereinafter called a milling drum, to prepare the ground.

The road milling machines have a transport device in order to be able to convey all the milled material from the milling drum housing to a transport vehicle (complete material loading). The volume of the milled material to be transported from the milling drum housing is determined by the width of the milling drum (milling width) and the milling depth. When the milled material is to be loaded during operation, the lower edge of the height-adjustable sealing element of the sealing device slides or scrapes on the milled surface, so that the surface is stripped away cleanly. Therefore, in a road milling machine, the sealing element is also called a scraper element or scraper blade or scraper. The milling drum housing is closed with the sealing element behind the milling drum in the working direction.

In addition to the rear sealing element, the road milling machines also have a sealing element arranged in front of the milling drum in the working direction, which is also called a hold-down device. In addition to the hold-down device and the scraper, road milling machines each have a right and left edge protection extending in the working direction, which laterally close the milling drum housing.

The road milling machines also provide for another operating mode, in which only part of the milled material is to be loaded (partial material loading) or no milled material is to be loaded (no material loading), so that the remaining part of the milled material or all the milled material remains in the milling track. For this operating mode, it is necessary to raise the sealing element. However, if the sealing element is too low above the remaining milled material, the milled material is retained in the milling drum housing, so that the milling drum housing increasingly fills with material, which creates additional friction and reduces efficiency and increases wear and fuel consumption. On the other hand, the sealing element cannot be raised as desired, since the milling drum housing would otherwise be at least partially open behind the milling drum in the working direction. However, the milling drum housing should always be largely closed because milled material could otherwise be thrown from the milling drum housing, and there is a risk of unintentionally reaching into the milling drum housing.

Stabilisers do not have a transport device. Therefore, when stabilising, the sealing element, which seals the drum housing towards the rear, must be adjusted such that the material can escape from the drum housing. This is also the case with embodiments of recyclers that do not have a transport device.

DE 10 2013 013 967 A1 (U.S. Pat. No. 9,322,139) describes a road milling machine that has a sealing device with a height-adjustable sealing element. The construction machine has a controller for an adjustment device for adjusting the height of the sealing element and a measuring device for measuring the distance between the lower edge of the sealing element and the milled material remaining in the milling track. The controller is designed such that the height of the sealing element is adjusted on the basis of the height of the milled material. This ensures that the milled material can escape largely unhindered from the milling drum housing in the working direction behind the milling drum and that the milling drum housing is largely closed above the exiting material. However, it is disadvantageous that an additional distance measuring device with a corresponding sensor system must be provided. In addition, in the operating mode in which the milled material is not to be completely loaded, the milled material cannot be stripped away because a gap remains between the lower edge of the sealing element and the material.

The problem addressed by the invention is that of providing a self-propelled construction machine, in particular a road milling machine, which can also be operated when the milled material is not to be loaded, at least not entirely, but is to remain at least to some extent in the milling track. A further problem addressed by the invention is that of specifying a method for operating a self-propelled construction machine when the milled material is not to be loaded, at least not entirely, but is to remain in the milling track.

According to the invention, these problems are solved by the features of the independent claims. The dependent claims relate to preferred embodiments of the invention.

The self-propelled construction machine according to the invention is in particular a road milling machine which has in particular a transport device for conveying the milled material from the milling drum housing to a transport vehicle. The road milling machine can be a front-loading road milling machine with which the milled material can be loaded over the front of the machine onto a truck travelling in front, or a rear-loading road milling machine with which the milled material can be loaded over the rear onto a truck following behind.

The self-propelled construction machine has a machine frame and a milling drum which is arranged in a milling drum housing having a sealing device which has at least one sealing element arranged behind the milling drum in the working direction of the construction machine for closing the milling drum housing, an adjustment device for adjusting the height position of the sealing element in relation to the milling drum, and a controller for controlling the adjustment device of the at least one sealing element.

A sealing element refers to any element with which the milling drum housing is closed towards the ground. However, this does not mean that the drum housing is completely sealed. However, the sealing element prevents milled material from being thrown from the milling drum housing and unintentional reaching into the drum housing. Since the sealing element in the construction machine according to the invention does not have to be used to scrape off milled material, the sealing element does not have to rest on the milled material.

The self-propelled construction machine is characterised in that the sealing device has at least one scraper element which is pivotably arranged on the at least one sealing element such that the at least one scraper element rests on the milled material in one operating mode of the construction machine, so that, when the scraper element is pulled over the milled material with the advancing construction machine, the scraper element is pivoted in relation to the milling drum on the basis of the height of the milled material. 'Scraper element' therefore refers to any element that can be pulled over the surface of the material that has been milled off.

The above-mentioned operating mode of the construction machine can be an operating mode specified by the machine operator. However, the construction machine can also provide other operating modes that can be specified by the machine operator, in which the sealing element and/or scraper element assumes other positions.

The self-propelled construction machine has a measuring device for determining the pivot position of the at least one scraper element. The measuring device generates a measurement signal that correlates with the pivot position and is received by the controller of the adjustment device of the at least one sealing element. The measurement signal can be an analogue or digital measurement signal that describes the pivot position of the scraper element. The pivot position of the scraper element is in turn determined by the height of the milled material which supports the pivotable scraper element.

The controller of the adjustment device of the at least one sealing element is configured such that the adjustment device adjusts the height position of the at least one sealing element on the basis of the pivot position of the at least one scraper element such that the pivot position of the scraper element is within a predetermined pivoting range. This ensures that the at least one sealing element is always in the correct height position when the construction machine advances, without the risk of milled material being retained in the milling drum housing and unintentional reaching into the drum housing. If the milled material accumulates in the drum housing, the sealing element is automatically raised. Milled material can accumulate in the milling drum housing, for example, if the milling parameters, for example, the advance speed and/or milling depth, are changed, or if an insufficient volume of milled material is removed from the drum housing per unit of time in order to load the milled material.

In the construction machine according to the invention, the scraper element is not only used to scrape off milled material, but also as a tactile element for scanning the milled material remaining in the milling track.

For the functional principle of the invention, it is irrelevant how the adjustment device for raising and lowering the at least one sealing element is designed.

It is also irrelevant how the scraper element is designed, as long as the scraper element rests on the milled material with sufficient contact force to be able to scrape off the milled material. The scraper element should therefore not only slide over the milled material. The contact force of the scraper element can be its weight force. However, the scraper element can also be pressed onto the milled material with a contact force that is greater than the weight force of the scraper element.

The specified pivoting range of the scraper element can be defined by an upper and lower limit value. The pivoting range can be fixed for the construction machine or specified by the machine operator.

One embodiment of the invention provides that the controller of the adjustment device of the at least one sealing element is configured such that the adjustment device raises the at least one sealing element when the scraper element is pivoted upwards during the advance of the construction machine, and lowers the sealing element when the scraper element is pivoted downwards during the advance of the construction machine. The height of the sealing element can be adjusted in a continuous process, so that the movement of the sealing element follows the movement of the scraper element.

The controller of the adjustment device of the at least one sealing element can be configured such that the adjustment device raises the at least one sealing element when an angle between the scraper element and the sealing element is set that is greater than an upper limit value, and lowers the sealing element when an angle between the scraper element and the sealing element is set that is smaller than a lower limit value. In this case, an angle between the scraper element and the sealing element is defined, which increases when the scraper element is raised and decreases when the scraper element is lowered, which corresponds to the smallest cutting angle. If another angle is defined, the movement occurs in an analogous way. By specifying the limit values for the corresponding angles, the permissible pivoting range and thus the reaction time of the system can be determined.

A further embodiment provides that an upper portion of the at least one scraper element is fastened to the sealing element such that it can be pivoted about an axis running parallel to the axis of rotation of the milling drum. The scraper element is preferably mounted at its uppermost edge in an articulated manner. In principle, the scraper element does not need to be fastened directly to the sealing element. However, the scraper element should follow the vertical movement of the sealing element. The scraper element can be pivotably fastened to the rear side of the at least one sealing element in the working direction. One particular embodiment provides that the scraper element is designed as a plate that is pivotably fastened to the sealing element.

The measuring device for measuring the angle between the at least one sealing element and the at least one scraper element can have at least one angle sensor in order to be able to measure the angle directly. However, the measuring device can also have other sensors with which the angle is not measured directly but a variable that correlates with the angle is detected instead.

A further embodiment provides a linear drive system for adjusting the at least one scraper element, which acts on the at least one scraper element such that, when it is actuated, a lower scraping edge of the scraper element is raised or lowered in relation to the sealing element, wherein it is possible to apply a predetermined contact force.

For controlling the linear drive system, a control device can be provided, which is configured such that the lower scraping edge of the at least one scraper element rests on the milled material with a predetermined contact force.

One embodiment of the linear drive system provides at least one piston/cylinder arrangement, the piston of which acts on the at least one sealing element and the cylinder of which acts on the at least one scraper element, or the piston of which acts on the at least one scraper element and the cylinder of which acts on the at least one sealing element. This embodiment has the advantage that the angle between the scraper element and the sealing element can be easily detected by the stroke position of the piston of the piston/cylinder arrangement. In this embodiment, the measuring device can have at least one position sensor for measuring the stroke position of the piston of the piston/cylinder arrangement.

The linear drive system not only allows for the required contact pressure to be applied, but also for the height of the scraper element to be adjusted. The control device for controlling the linear drive system can be configured such that an operating mode can be set in which the scraper element is folded up. It is also possible to provide two operating modes, wherein the control device is configured such that, in one operating mode, the scraper element is only partially folded up, for example, in a horizontal position, or is completely folded up.

The pressing force required for the scraper element can also be applied with a spring which acts on the at least one scraper element and also on the at least one sealing element.

The method according to the invention relates to the operation of a self-propelled construction machine, in particular a road milling machine, recycler or stabiliser, having a machine frame and a milling drum which is arranged in a milling drum housing having a sealing device which has at least one sealing element arranged behind the milling drum in the working direction of the construction machine for closing the milling drum housing. The method according to the invention provides for a determination of the pivot position of at least one scraper element which is pivotably arranged on the at least one sealing element such that the at least one scraper element rests on the milled material in one operating mode of the construction machine, so that, when the construction machine advances, the scraper element is pulled over the milled material and pivoted in relation to the milling drum on the basis of the height of the milled material. The height position of the at least one sealing element is adjusted on the basis of the pivot position of the at least one scraper element such that, when the construction machine advances, the pivot position of the scraper element is within a predetermined pivoting range. In this case, the at least one sealing element can be pressed onto the ground with a predetermined contact force.

BRIEF DESCRIPTION OF THE DRAWINGS

In the following, one embodiment of the invention is described in greater detail with reference to the drawings, in which.

DETAILED DESCRIPTION

Figure 1:
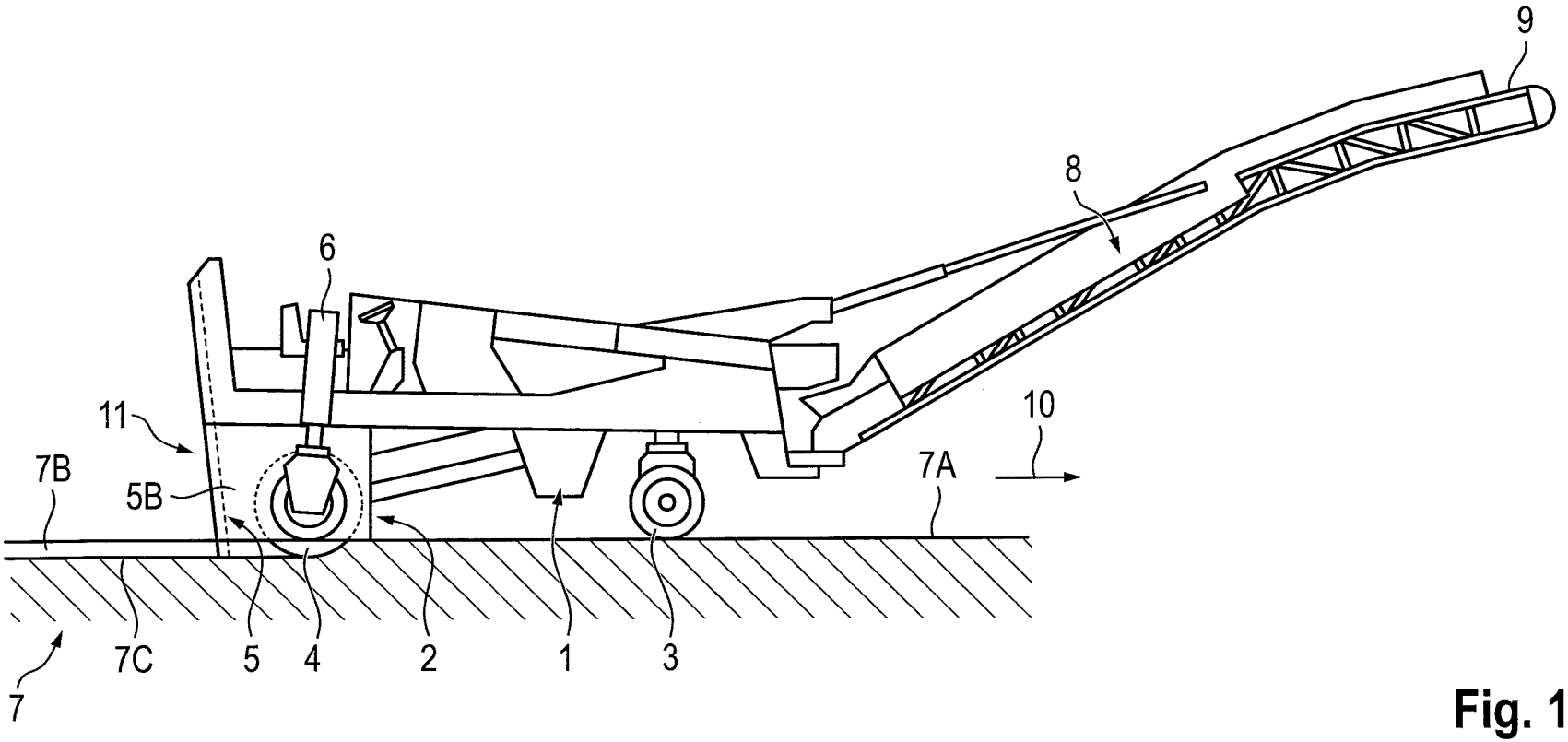
FIG. 1 is a side view of a self-propelled construction machine according to the invention.

FIG. 1 shows the essential components of a road milling machine as an example of a self-propelled construction machine. The road milling machine has a machine frame 1 and a chassis 2 which can comprise front and rear wheels 3 or crawler drives. In the present embodiment, the road milling machine has a left and right rear wheel and only one front wheel 3. However, the road milling machine can also have a left and right front wheel.

In addition, the road milling machine has a milling drum 4 which is arranged in a milling drum housing 5 on the machine frame 1. In the present embodiment, the milling drum housing 5 is located at the rear of the machine.

In the present embodiment, the machine frame 1 can only be adjusted in height relative to the surface 7A of the ground 7 by means of rear piston/cylinder arrangements 6. The milling depth is adjusted by raising or lowering the machine frame 1 relative to the ground 7. However, the construction machine can also have a front piston/cylinder arrangement for adjusting the height of the machine frame, which is assigned to the wheel(s) or drives.

The milling track is denoted by reference sign 7B and its surface by 7C. The milled material can be loaded onto a transport vehicle. For this purpose, the road milling machine has a transport device 8 with a conveyor belt 9, which transports the milled material from the milling drum housing 5 to a lorry. If the milled material is not loaded, it is located in the milling track 7B on the surface 7C.

On the left and right side in the working direction 10, the milling drum housing 5 is closed by lateral plates 5A, 5B, wherein only the right lateral plate 5B in the working direction is visible in FIG. 1. A sealing device 11 is located behind the milling drum 4 in the working direction 10. The sealing device 11 may also be referred to as a sealing assembly 11.

Figure 2A:
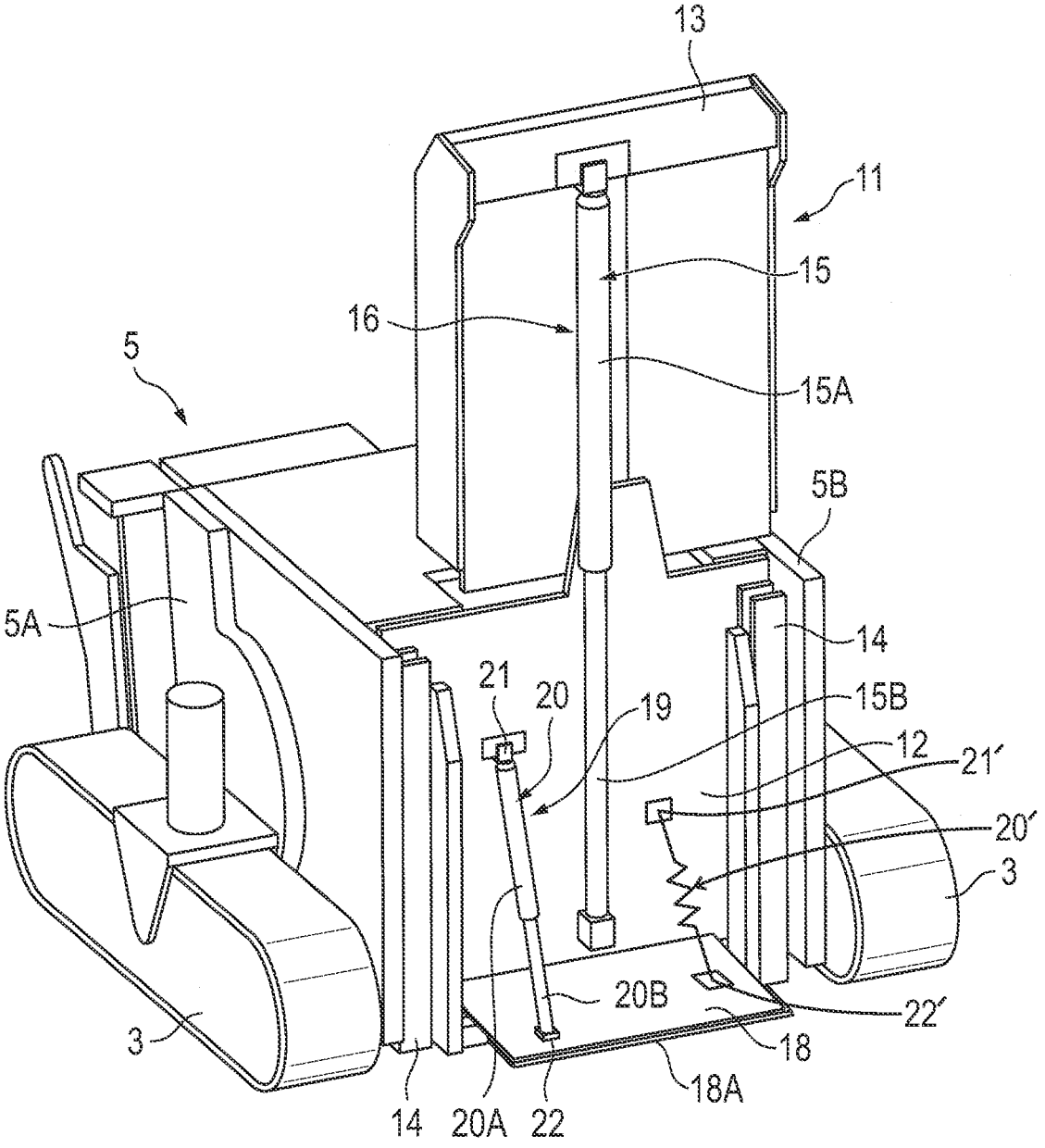
FIG. 2A is a partial view of the milling drum housing of a self-propelled construction machine according to the invention, which has a sealing device, wherein the sealing element is moved upwards.
Figure 2B:
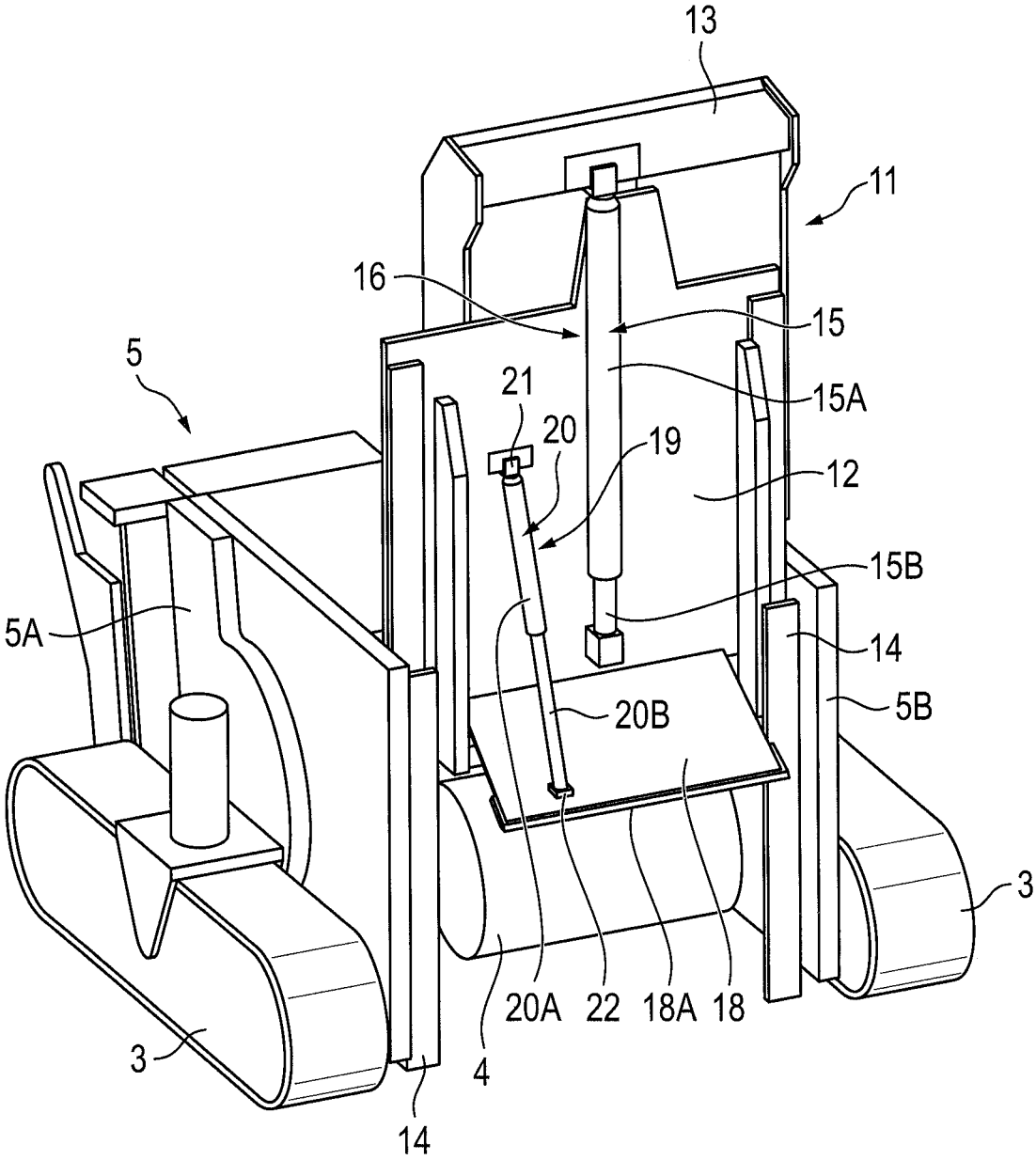
FIG. 2B is a partial view of the milling drum housing of a self-propelled construction machine according to the invention, which has a sealing device, wherein the sealing element is moved downwards.

FIGS. 2A and 2B are perspective views of the milling drum housing 5 with the sealing device 11. The sealing device 11 has a height-adjustable sealing element 12 with which the milling drum housing 5 can be closed at the rear. The plate-shaped sealing element 12 is guided in a portal 13 on the machine frame 1 in lateral guides 14. In this case, the sealing element 12 can be positioned at a slight angle relative to the ground. Instead of a single sealing element, a plurality of sealing elements can also be provided. The sealing element 12 may also be referred to as a sealing wall 12.

For adjusting the height of the sealing element 12, an adjustment device 16 is provided which has a piston/cylinder arrangement 15, the cylinder 15A of which is fastened to the portal 13 in an articulated manner and the piston 15B of which is fastened to the sealing element 12 in an articulated manner. FIG. 2A shows the sealing element 12 in the lowered position and FIG. 2B in the raised position.

For controlling the adjustment device 16 for adjusting the height of the sealing element 12, in particular the piston/cylinder arrangement 15, a controller 17 is provided which is configured such that the sealing element 12 can be raised or lowered. The controller 17 of the sealing element 12 can be a separate controller or part of the central control and computing unit of the construction machine. The adjustment device 16 may also be referred to as a height actuator 16.

The sealing device 11 also has a scraper element 18 which is pivotably fastened to the rear side of the sealing element 12 in the working direction 10. In the present embodiment, the scraper element 18 is designed as a substantially rectangular plate which is connected in an articulated manner to the plate-shaped sealing element 12 on an upper portion of a broad side, wherein the sealing element 12 is pivotable about a (horizontal) axis running parallel to the axis of rotation 4A (FIG. 3) of the milling drum 4. The scraper element 18 preferably extends over the entire width of the milling drum 4, but can also only extend over part of the width of the milling drum. It is also possible for a plurality of scraper elements to be pivotably fastened to the sealing element. The lower portion of the scraper element 18 forms a (horizontal) scraping edge 18A running parallel to the axis of rotation 4A of the milling drum 4 and resting on the surface 7D of the milled material 7E remaining in the milling track 7B.

For pivoting the scraper element 18, a linear drive system 19 (FIG. 4) is provided which in the present embodiment comprises a piston/cylinder arrangement 20 which is arranged in a plane running perpendicular to the axis 4A of the milling drum 4. The linear drive system 19 may also be referred to as a linear actuator 19. The upper end of the cylinder 20A of the piston/cylinder arrangement 20 is connected in an articulated manner to the rear side of the plate-shaped sealing member 12 by means of a first articulated joint 21 and the lower end of the piston 20B of the piston/cylinder arrangement 20 is connected in an articulated manner to the upper side of the plate-shaped scraper element 18 by means of a second articulated joint 22, so that the scraper element 18 can be lowered by extending the piston 20B and raised by retracting the piston 20B of the piston/cylinder arrangement 20.

Figure 5:
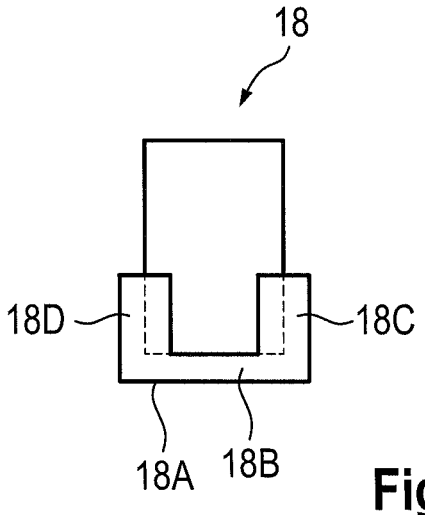
FIG. 5 is a plan view of an embodiment of the scraper element of the sealing device.

In the present embodiment, the scraper element 18 is a substantially rectangular metal plate, on the lower broad side and on the two narrow sides of which a strip 18B, 18C, 18D made of a flexible material, for example, a rubber flap, is fastened (FIG. 5). The lower strip of material 18B forms the scraping edge 18A and the lateral strips of material 18C, 18D flexibly seal the scraper element 18 on both sides with regard to the sides of the milling track 7B, so that the milling drum housing 5 is closed off at the bottom. This flexible seal also prevents damage to the scraper element 18 under mechanical stress. The strips of material 18B, 18C, 18D can be screwed to the metal plate, so that the strips can be replaced when worn.

In the present embodiment, the scraping edge 18A of the scraper element 18 is kept pressed to the ground with a predetermined contact force. When the construction machine advances, the milled material is thrown up in the form of a wall, which can have its greatest height in the middle of the milling track. The scraper element 18 grazing the ground with a predetermined contact force smooths the milled material, wherein the milled material is moved to the sides, so that the region below the scraper element is closed over the entire width of the milling track.

Figure 4:
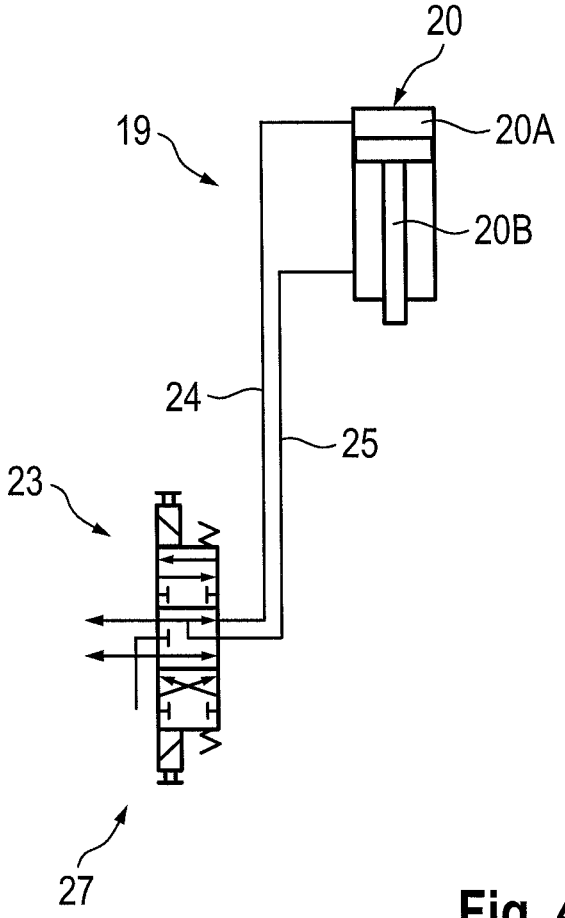
FIG. 4 shows a hydraulic circuit diagram of the control device for controlling the linear drive system of the scraper element of the sealing device.

For controlling the linear drive system 19, a preferably hydraulic control device 27 is provided, wherein FIG. 4 only shows part of its hydraulic system. The control device 27 of the linear drive system 19 for pivoting the scraper element 18 and the controller 17 of the adjustment device 16 for adjusting the height of the sealing element 12 can be separate devices or form a common device, which can also be at least to some extent part of the central control unit of the construction machine.

FIG. 4 shows a simplified hydraulic circuit diagram of the control device of the scraper element 18 with the piston/cylinder arrangement 20 for raising or lowering the scraper element 18. During the advance of the construction machine, the scraper element 18 is in a floating position, so that the scraper element rests on the milled material with a predetermined contact force. In the floating position, a hydraulic valve 23 of a hydraulic unit (not shown in more detail) connects the upper and lower cylinder chamber of the cylinder 20A of the piston/cylinder arrangement 20 to a hydraulic tank (not shown) via hydraulic lines 24, 25 connected to the cylinder connections, so that the system pressure is not applied to the cylinder chambers. The hydraulic valve 23 is a 4/3-way valve. The hydraulic lines leading to the valve are not shown for the sake of simplicity. Since no specific hydraulic force acts on the cylinder 20A, the piston 20B can move in the cylinder, so that the scraper element 18 pivots downwards due to its weight force. With the same pressure in both cylinder chambers, this downward movement can be further supported with a corresponding design of the effective contact surfaces of the hydraulic cylinder if a pressure, which preferably does not correspond to the system pressure, is applied to both chambers in the floating position. By switching the hydraulic valve 23, the system pressure can be applied to one or the other hydraulic line 24, 25 (pressure line) or one or the other hydraulic line can be connected to the tank (tank line), so that the piston 20B is moved up or down to pivot the scraper element 18. The contact pressure can be a contact pressure specified by the controller, which can preferably be adjustable by the machine operator within specified limits.

Instead of a piston/cylinder arrangement 20, the sealing device can also have a spring element 20' schematically shown in FIG. 2A for applying a pressing force, for example, one or more compression springs, wherein one end 22' of the spring 20' is connected to the scraper element 18 and the other end 21' of the spring 20' is connected to the sealing element 12.

Figure 3:
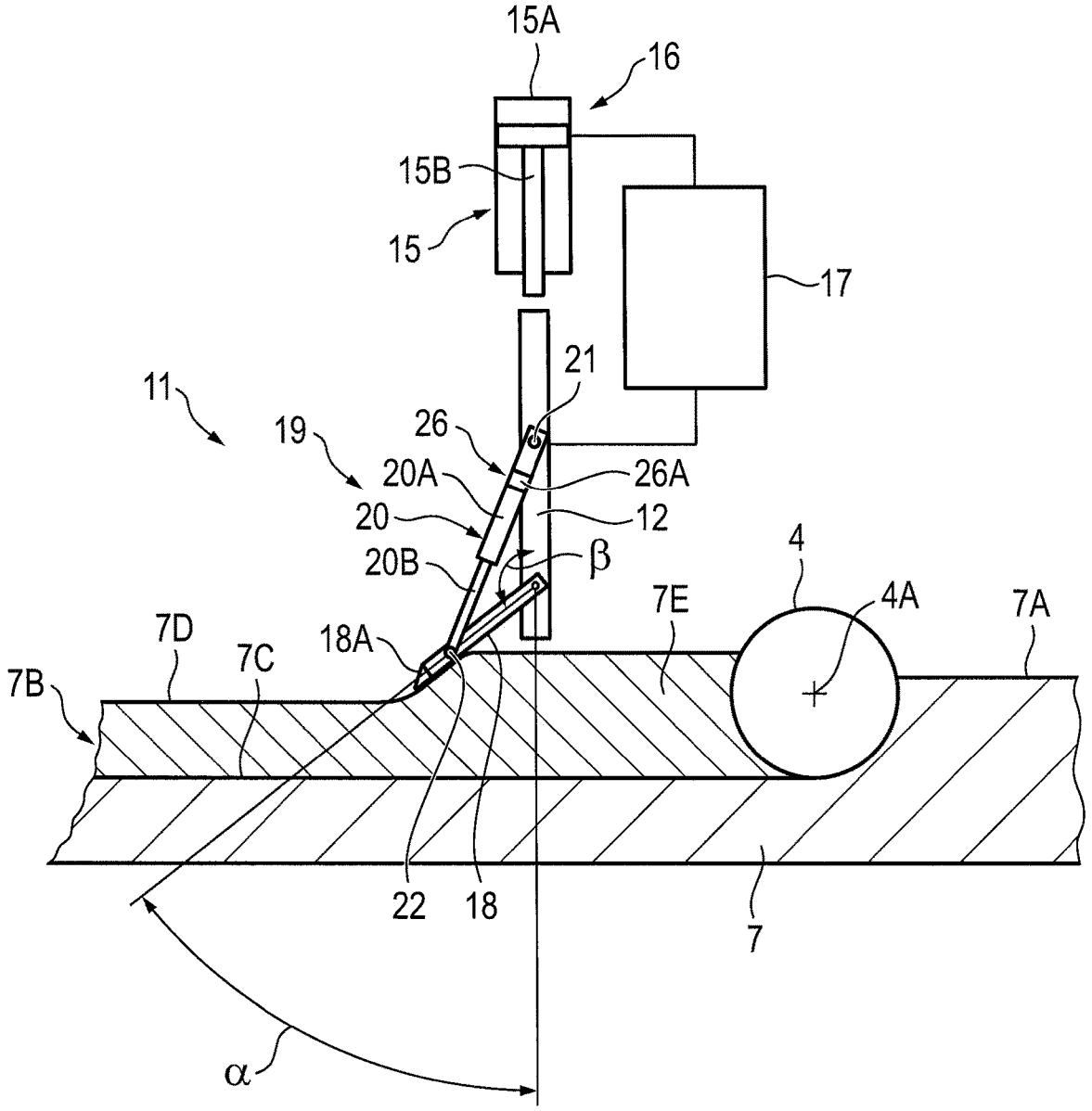
FIG. 3 shows the sealing element and the scraper element of the sealing device and the controller for controlling the adjustment device for adjusting the height of the sealing element in a simplified schematic representation, wherein the scraper element is in a correct angular position.

The sealing device 11 also has a measuring device 26 for determining the angle denoted with a in FIG. 3 and enclosed by the sealing element 12 and the scraper element 18. However, instead of the angle $\alpha$, the angle $\beta(\beta=180°-\alpha)$ can also be defined, although the conditions would then be reversed. The angle α may also be referred to as the acute angle between the sealing element 12 and the scraper element 18, as contrasted to the angle β which is the obtuse angle between the sealing element 12 and the scraper element 18. When the sealing element is folded up, α increases and β decreases. For determining the angle, the sealing device can have an angle sensor. Such sensors are part of the prior art. However, in the present embodiment, the angle is measured with a position sensor 26A which measures the path by which the piston 20A of the piston/cylinder arrangement 20 is retracted or extended. The position sensor 26A generates a measurement signal that correlates with the angle α (β). Since the geometric conditions are known, the angle can be deduced from the path. Position sensors for piston/cylinder arrangements are part of the prior art. The use of a position sensor instead of an angle sensor has the advantage that the position sensor 26A can be easily integrated into the piston/cylinder arrangement 20.

The construction machine provides different operating modes that can be specified by the machine operator. One operating mode of the construction machine is described below with reference to FIG. 3 and FIGS. 6A and 6B as well as FIGS. 7A and 7B, in which the milled material is not transported away from the milling drum housing 5 by the transport device 8 and thus remains in the milling track 7B, or in which only some of the material is picked up. In this operating mode, which the machine operator can specify, the sealing element 12 does not scratch the surface of the milled ground with the lower edge.

FIG. 3 shows the scraper element 18 in a pivot position that is optimal for adjusting the height of the sealing element. The sealing element 12 is in a position in which its lower edge is slightly above the surface 7D of the milled material 7E, so that material is not retained by the sealing element. The scraper element 18 is in a position in which its lower scraping edge 18A is located below the lower edge of the sealing element 12. The milling drum housing 5 is thus sealed off at the bottom and on the sides.

The scraper element 18 is inclined relative to the sealing element 12 such that no material jam occurs in the milling drum housing 5. With increased counter-pressure due to a material jam, the scraping edge 18A of the scraper element 18 is raised, i.e., the scraper element is pivoted clockwise, and with reduced counter-pressure, the scraping edge of the scraper element 18 is lowered, i.e., the scraper element is pivoted anti-clockwise. The target angle $\alpha_{soil}$ between the scraper element and the sealing element should be between 10° and 80°, preferably greater than 45°, particularly preferably greater than 60°. In the present embodiment, a target angle of 65° is assumed, wherein the scraper element 18 is to be raised if the angle α is greater than 68° and lowered if the angle α is smaller than 62°. The target angle $\alpha_{soil}$ is preferably a pre-set angle that cannot be changed by the machine operator, or the target angle $\alpha_{soil}$ can only be changed by the machine operator within specified limits.

The control device 27 of the linear drive system 19 for pivoting the scraper element 18 and/or the controller 17 of the adjustment device 16 can comprise analogue or digital circuits and can be a separate device or part of a central computing and controller of the construction machine. For example, the data or signal processing device can have a generic processor, a digital signal processor (DSP) for continuous processing of digital signals, a microprocessor, an application-specific integrated circuit (ASIC), an integrated circuit consisting of logic elements (FPGA), or other integrated circuits (IC) or hardware components. A data processing program (software) can be run on the hardware components. A combination of the different components is also possible.

The controller 17 of the adjustment device 16 is configured such that the sealing element 12 is moved such that the angle α lies within the desired pivoting range.

Figure 6A:
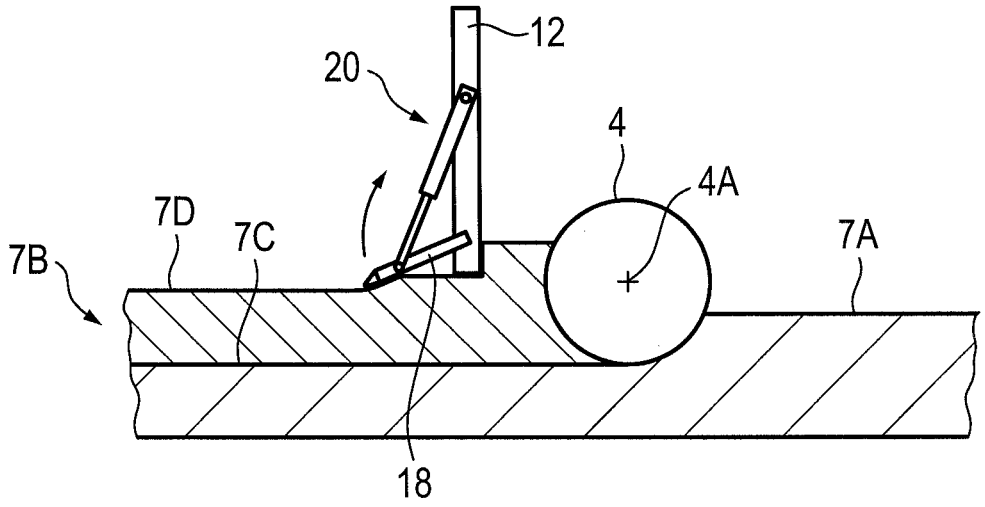
FIG. 6A shows the position of the sealing element and the scraper element in relation to the milling drum during the advance of the self-propelled construction machine with no or partial material loading at a time $T_1$, wherein the volume of milled material in the milling drum housing increases, thus raising the scraper element.

FIG. 6A shows the case in which material accumulates in the milling drum housing, for example, due to a change in the milling parameters, so that the pressure of the material against the sealing element 12 and the scraper element 18 increases. As a result, the scraper element 18 is raised, so that the angle α increases. This change in angle is detected by the measuring device 26. If the angle increases, the controller 17 actuates the piston/cylinder arrangement 15 such that the sealing element 12 is raised. However, in the present embodiment, the sealing element 12 is not raised until the angle α is greater than an upper limit value.

Figure 6B:
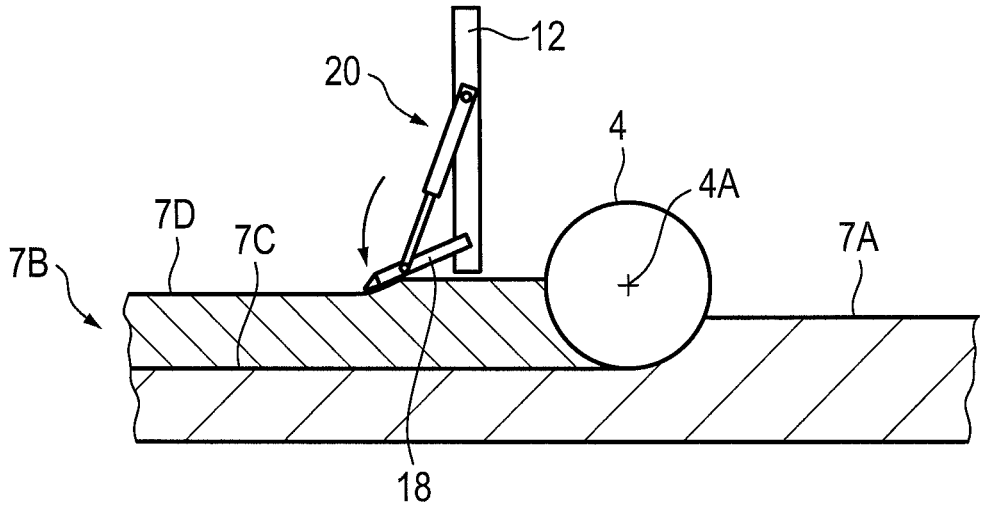
FIG. 6B shows the position of the sealing element and the scraper element at a time $T_2$ after the sealing element is raised.

When the sealing element 12 is raised, the pressure of the material against the sealing element 12 and the scraper element 18 decreases again, so that the scraper element 18 is lowered again (FIG. 6B). This change in angle is detected by the measuring device 26. If the angle decreases, the controller 17 actuates the piston/cylinder arrangement 15 such that the sealing element 12 is lowered. When the scraper element 18 has reached a predetermined lower limit value, in particular assumes the predetermined target angle α, the scraper element 18 remains in the current height position, so that the drum housing is still sealed and a material jam is prevented.

Figure 7A:
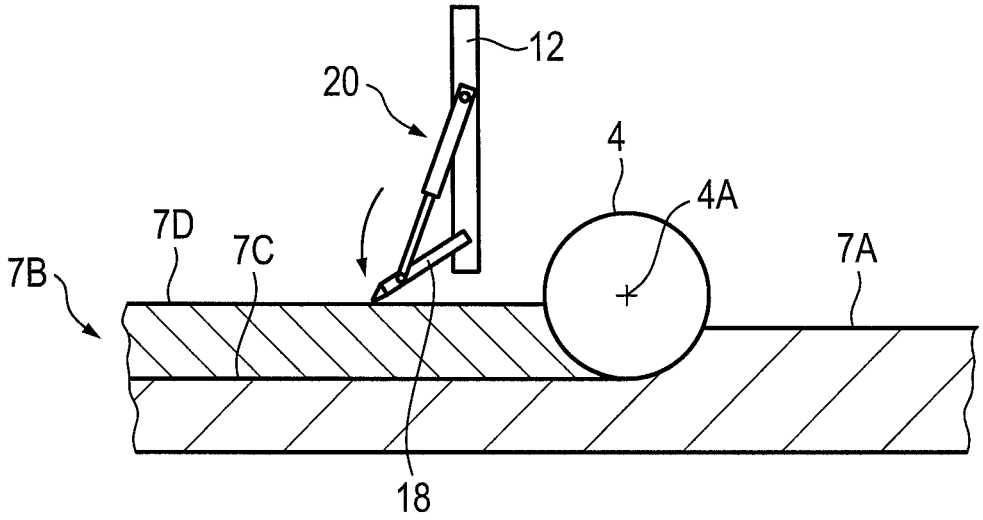
FIG. 7A shows the position of the sealing element and the scraper element at a time $T_1$, wherein the volume of milled material in the milling drum housing decreases, thus lowering the scraper element.
Figure 7B:
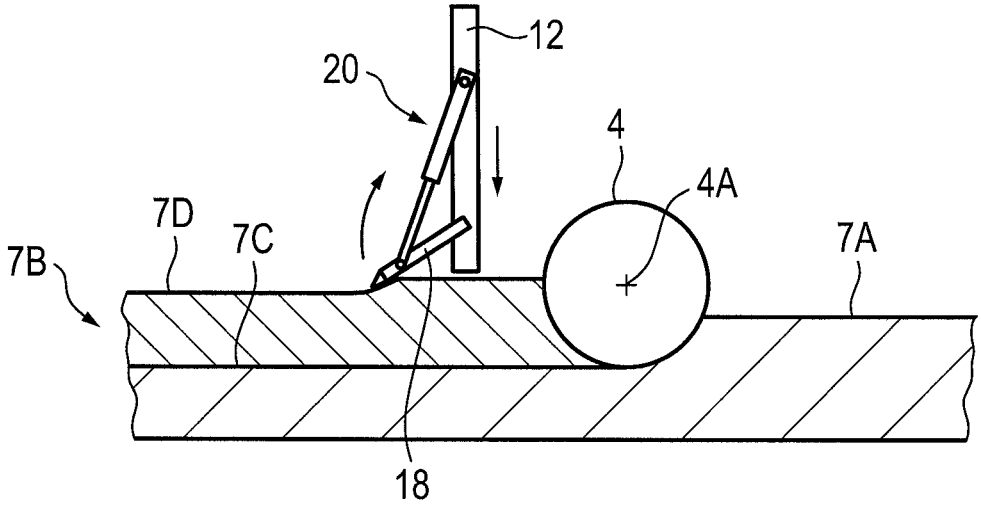
FIG. 7B shows the position of the sealing element and the scraper element at a time $T_2$ after the sealing element is lowered.

FIG. 7A shows the opposite case in which the volume of material accumulated in the milling drum housing decreases, so that the pressure of the material decreases. As a result, the scraper element 18 is lowered, so that the angle α decreases. This change in angle is detected by the measuring device 26. If the angle decreases, the controller 17 actuates the piston/cylinder arrangement 15 such that the sealing element 12 is lowered.

The control device 27 of the linear drive system 19 can also be configured such that the machine operator can specify further operating modes. For example, the machine operator can select these operating modes on an input unit.

Figure 8:
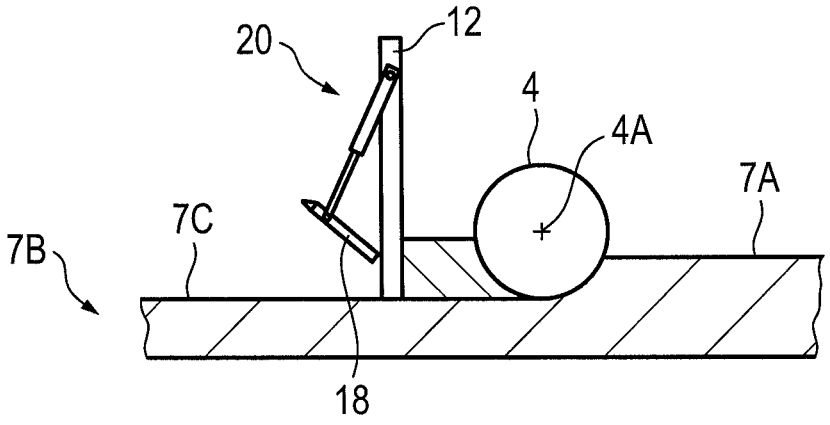
FIG. 8 shows the position of the sealing element and the scraper element in an operating mode in which the milled material is loaded entirely.

FIG. 8 shows the case of a complete material loading. If the milled material is to be transported away completely, i.e., is not to remain in the milling track, the sealing element 12 is moved downwards, so that it scratches the ground as the machine advances. The sealing element 12 thus seals the milling drum housing towards the rear. In this operating mode, the sealing element 12 also acts as a scraper element. For this operating mode, the scraper element 18 is pivoted upwards as far as possible with the piston/cylinder arrangement 20, so that it cannot jam in the milling track during steering movements (FIG. 8).

Figure 9:
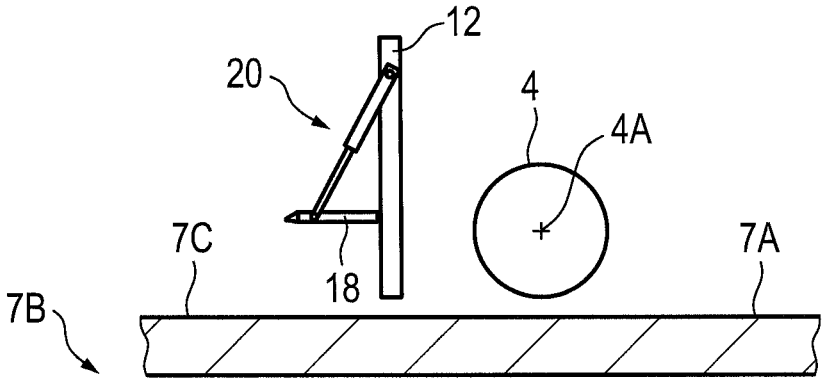
FIG. 9 shows the position of the sealing element and the scraper element in an operating mode in which the sealing element is in a partially raised position.

FIG. 9 shows the operating mode of a shunting movement. For shunting, the scraper element is pivoted with the piston/cylinder arrangement 20 into a position in which the angle α is 90°.

Figure 10:
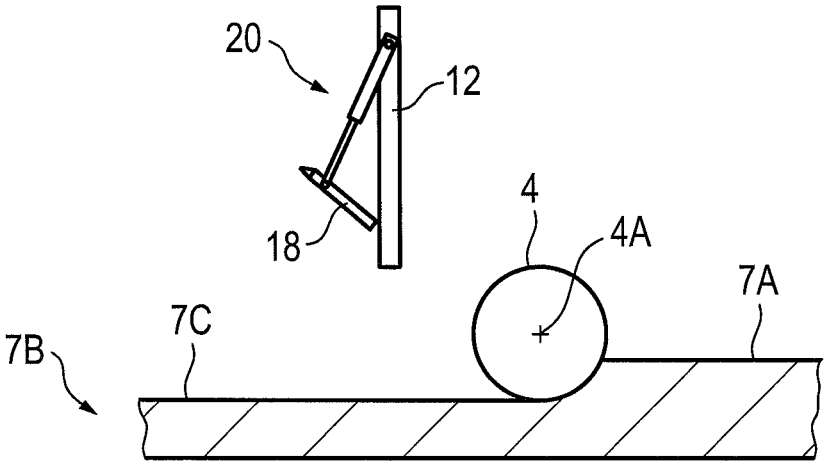
FIG. 10 shows the position of the sealing element and the scraper element in an operating mode in which the sealing element is in a fully raised position.

FIG. 10 shows the operating mode of a maintenance position, for example, for changing the chisel of the milling drum. For maintenance, the sealing element 12 is fully raised, wherein the piston 15B of the piston/cylinder arrangement 15 is fully retracted by the controller 17. The scraper element 18 is pivoted upwards as far as possible, wherein the piston 20B of the piston/cylinder arrangement 20 is fully retracted.

In addition, the scraper element 18 can also be controlled manually by the machine operator by actuating an operating element.

The invention claimed is:

1. A self-propelled construction machine, comprising:

a machine frame;

a milling drum;

a milling drum housing supported from the machine frame for receiving the milling drum, the milling drum housing including a sealing assembly configured to close the milling drum housing from behind relative to a working direction of the construction machine, the sealing assembly including:

at least one sealing wall; and at least one scraper element pivotably mounted on the sealing wall such that the scraper element may rest on milled material and be pulled over the milled material as the construction machine advances, and such that a pivot position of the scraper element relative to the sealing wall varies dependent on a height of the milled material;

a height actuator configured to adjust a height position of the sealing wall in relation to the milling drum;

a sensor configured to detect the pivot position of the scraper element, the sensor being configured to generate a signal correlated with the pivot position; and a controller configured to receive the signal and to control the height actuator to adjust the height position of the sealing wall based on the pivot position of the scraper element such that the pivot position is maintained within a predetermined pivoting range.

2. The self-propelled construction machine of claim 1, wherein:

the controller is configured such that the height actuator raises the sealing wall when the scraper element is pivoted upwards and lowers the sealing wall when the scraper element is pivoted downwards.

3. The self-propelled construction machine of claim 1, wherein:

the controller is configured such that the height actuator raises the sealing wall when an acute angle between the scraper element and the sealing wall is greater than an upper limit value and lowers the sealing wall when the acute angle between the scraper element and the sealing wall is smaller than a lower limit value.

4. The self-propelled construction machine of claim 1, wherein:

an upper portion of the scraper element is pivotally connected to the sealing wall such that the scraper element pivots about a pivot axis parallel to an axis of rotation of the milling drum.

5. The self-propelled construction machine of claim 4, wherein:

the upper portion of the scraper element is pivotally connected to a rear side of the sealing wall relative to the working direction.

6. The self-propelled construction machine of claim 1, wherein:

the scraper element is configured as a plate pivotably connected to the sealing wall.

7. The self-propelled construction machine of claim 1, wherein:

the sensor is configured to detect an angle between the sealing wall and the scraper element.

8. The self-propelled construction machine of claim 1, further comprising:

a linear actuator configured to adjust the pivot position of the scraper element to raise and lower the scraper element relative to the sealing wall.

9. The self-propelled construction machine of claim 8, further comprising:

a linear actuator control device configured to control the linear actuator such that a lower scraping edge of the scraper element rests on the milled material with a predetermined contact force.

10. The self-propelled construction machine of claim 9, wherein the linear actuator control device is further configured to provide an operating mode in which the scraper element is folded up.

11. The self-propelled construction machine of claim 8, wherein:

the linear actuator includes a piston movable within a cylinder, one of the piston and the cylinder being connected to the sealing wall and the other of the piston and the cylinder being connected to the scraper element.

12. The self-propelled construction machine of claim 11, wherein:

the sensor is a position sensor configured to detect a position of the piston relative to the cylinder.

13. The self-propelled construction machine of claim 1, further comprising:

a spring acting on the scraper element and the sealing wall.

14. A method of operating a self-propelled construction machine, the construction machine including a machine frame, a milling drum arranged in a milling drum housing, the milling drum housing including a sealing assembly including at least one sealing wall arranged behind the milling drum relative to a working direction of the construction machine for closing the milling drum housing, the sealing assembly further including at least one scraper element pivotably connected to the sealing wall, the method comprising in a first operating mode:

resting the scraper element on milled material such that as the scraper element is pulled over the milled material when the construction machine advances a pivot position of the scraper element relative to the sealing wall changes based on a height of the milled material;

detecting the pivot position of the scraper element; and adjusting a height of the sealing wall based on the pivot position of the scraper element such that when the construction machine advances the pivot position is within a predetermined pivoting range.

15. The method of claim 14, wherein the adjusting step further comprises:

raising the sealing wall when the scraper element is pivoted upward during the advance of the construction machine; and lowering the sealing wall when the scraper element is pivoted downward during the advance of the construction machine.

16. The method of claim 14, wherein the adjusting step further comprises:

raising the sealing wall when an acute angle between the scraper element and the sealing wall is greater than an upper limit value during the advance of the construction machine; and lowering the sealing wall when the acute angle between the scraper element and the sealing wall is smaller than a lower limit value during the advance of the construction machine.

17. The method of claim 14, further comprising:

pressing the scraper element onto the milled material with a predetermined contact force.

18. The method of claim 14, further comprising:

in a second operating mode, folding up the scraper element.

* * * * *